United States Patent [19]

Nelson

[11] 4,190,904

[45] Mar. 4, 1980

[54] SASH TIE AND HOLDER

[76] Inventor: David J. Nelson, 306 S. 3rd St., Burlington, Iowa 52601

[21] Appl. No.: 937,995

[22] Filed: Aug. 30, 1978

[51] Int. Cl.[2] ..... A41B 1/18; A41D 25/10

[52] U.S. Cl. ..... 2/137; 2/145

[58] Field of Search ..... 2/130, 137, 144, 145, 2/146, 147, 148, 156

[56] References Cited

U.S. PATENT DOCUMENTS

| | | | |
|---|---|---|---|
| 2,886,823 | 5/1959 | Kuhlman | 2/145 |
| 3,027,055 | 3/1962 | Teague | 2/130 X |
| 3,128,470 | 4/1964 | Petermann et al. | 2/145 |
| 3,405,408 | 10/1968 | Baker | 2/145 |
| 3,639,916 | 2/1972 | Vaughn | 2/145 X |
| 3,733,614 | 5/1973 | Abramowitz | 2/144 |

*Primary Examiner*—Louis Rimrodt

*Attorney, Agent, or Firm*—Clarence A. O'Brien; Harvey B. Jacobson

[57] ABSTRACT

An item of wearing apparel is disclosed comprising a sash tie and sash tie holder which is conveniently mounted in place under the collar of a shirt without the necessity of tieing a conventional necktie knot. The sash tie fits over the holder and is provided with fastening means, such as conventional commercially available reusable cooperating tape of the hook and loop type. Corresponding tape is provided on the shirt of the wearer and holds the necktie securely in place.

10 Claims, 8 Drawing Figures

SASH TIE AND HOLDER

BACKGROUND OF THE INVENTION

1. Field of the Invention

The invention relates to an item of wearing apparel. More particularly, the invention discloses an improved necktie mountable securely on the shirt on a wearer, without the necessity for tieing of necktie knots.

2. Description of the Prior Art

Holders for supporting or fastening neckties in the region of a shirt collar are known, such as U.S. Pat. No. 2,508,472, issued May 23, 1950 to Scully. While Scully shows a tieing and suspended member having wings which fit beneath the shirt collar, Scully requires a neck encircling band to provide fastening means for the necktie, as disclosed at column 9. Baker in U.S. Pat. No. 3,405,408, issued Oct. 15, 1968, shows a conventionally knotted necktie having conventional commercially available reusable cooperating tape such as the hook and loop type upon the rearward facing surface of the necktie, for joining to a tie tack provided with cooperating fastening means and clipped or otherwise attached to the wearer's shirt. Palmer in U.S. Pat. No. 1,588,609, issued June 15, 1926, provides an elastic strip for supporting a necktie, the strip extending transversely of the tie and being attached by buttons passing through buttonholes in the elastic material.

Other necktie fastening devices are exemplified by U.S. Pat. No. 2,400,604 to Scully, and U.S. Pat. No. 2,396,446 to Stein. Also of interest are U.S. Pat. No. 2,632,893 to Melville, showing a knotted man's tie, and U.S. Pat. No. 3,151,332 to Chambon, showing a shirt decorating device comprising a simulated four-in-hand necktie attached to a shirt front.

None of the prior art patents listed discloses an item of neck wear easily and conveniently removably attachable under the collar without the necessity for tieing of a knot.

SUMMARY OF THE INVENTION

The invention provides an article of neckwear clothing conveniently and removably attachable under the collar of a shirt, thereby serving a decorative, as well as functional purpose. A strip or button having a layer of fastening tape such as the hook and loop type manufactured under the trademark Velcro is attached to the front portion of a shirt and a strip having a layer of complementary cooperating tape of the hook and loop type is fastened to the portion of the tie facing the shirt. The tie is looped over a holder, and when fastened appropriately to the shirt, the combination of tie and holder is held securely in place. Decorative embellishments can be applied, including a chain ornament, a campaign button, and the like.

Accordingly, an object of the invention is to provide an item of neckwear clothing having fastening means for conveniently and easily attaching the item to the shirt of a wearer, the item being easily removable therefrom.

Another object of the invention is to provide a holder for the fabric or cloth portion of the neckwear, the holder having the fastening means attached thereto.

Still another object of the invention is to provide an item of neckwear having decorative, as well as functional appeal.

A further object of the invention is to provide an item of neckwear adapted to hold decorative embellishments, such as a chain ornament or a campaign button.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
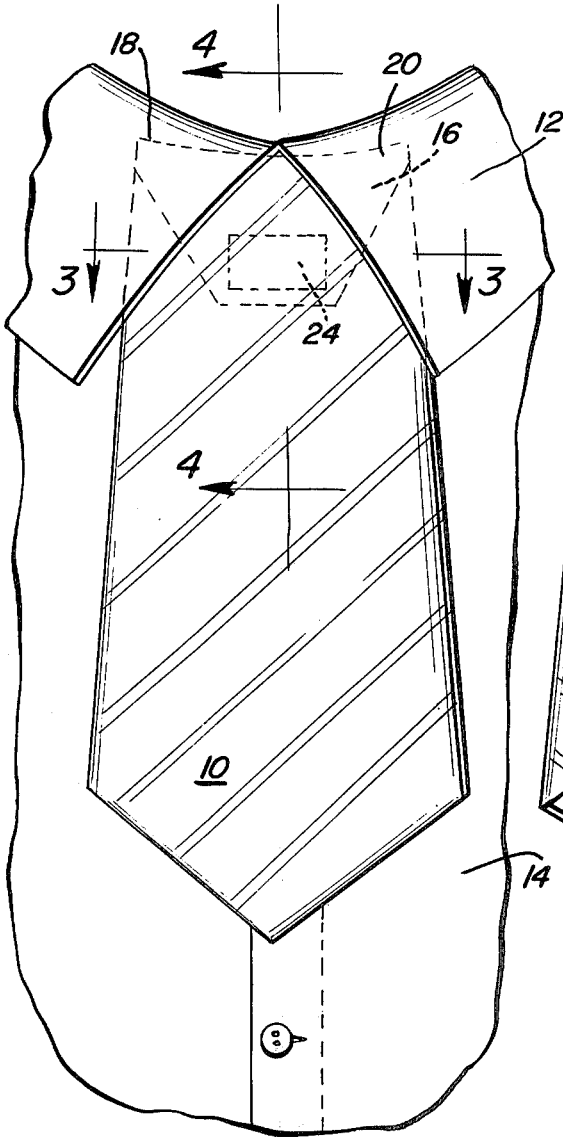
FIG. 1 is a front view of the present invention in use.
Figure 3:
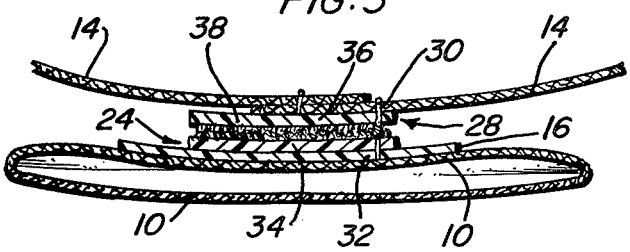
FIG. 3 is a transverse sectional view of the present invention, taken substantially upon a plane passing along section line 3—3 on FIG. 1.
Figure 4:
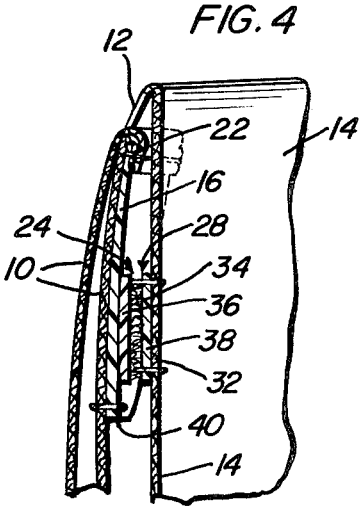
FIG. 4 is a partial longitudinal sectional view of the present invention taken substantially upon a plane passing along section line 4—4 on FIG. 1, showing details of association of the holder and fastening means.

In FIG. 1, sash tie 10 is held in place under collar 12 of shirt 14. Holder 16, which is made of a light piece of plastic of sufficient stiffness to support edges 18 and 20 of sash tie 10, is sewn or stitched across the top end of sash tie 10 between edges 18 and 20 at seam 22. Fastening strip 24 is glued, cemented, or stitched to holder 16 and presents outwardly a layer of hook and loop type fastener, such as manufactured under the trade name Velcro. Such fasteners have a distinctive orientation, for proper cooperative joinder. Accordingly, the fastener 24 is provided with a right-handed orientation, while the corresponding fastener 26, which is sewn or stitched at seams 28 and 30 to shirt 14, is provided with the opposite, or left-handed orientation. Accordingly, application of fastener 24 to fastener 26 with application of manual pressure causes engagement of the surface layers and a secure attachment of sash tie 10 to shirt 14. In FIG. 3, fastener 24 can be seen to comprise backing layer 32 and surface layer 34, which merges with the surface layer 36 from fastener 26 having backing layer 38. Stitch 40 holds the lower portion of holder 16 to the material of sash tie 10.

Figure 5:
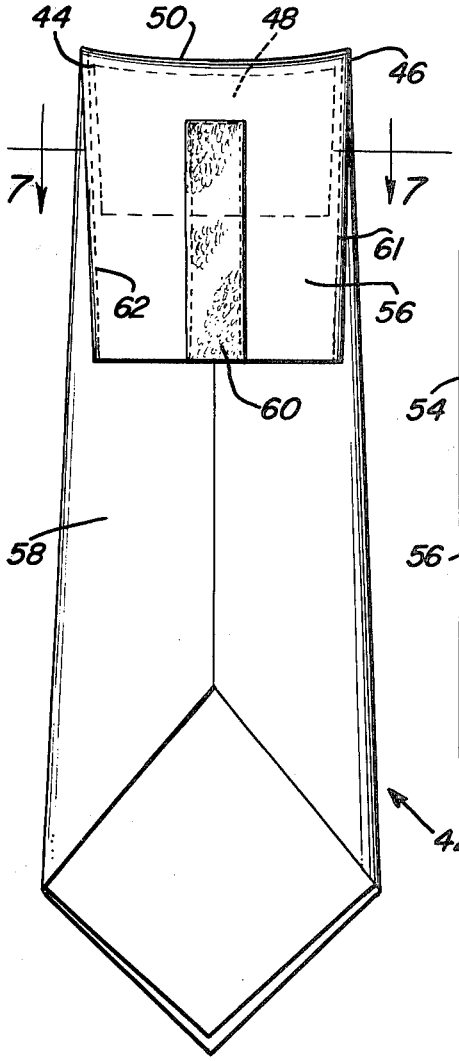
FIG. 5 is a back view of a second embodiment of the present invention.
Figure 6:
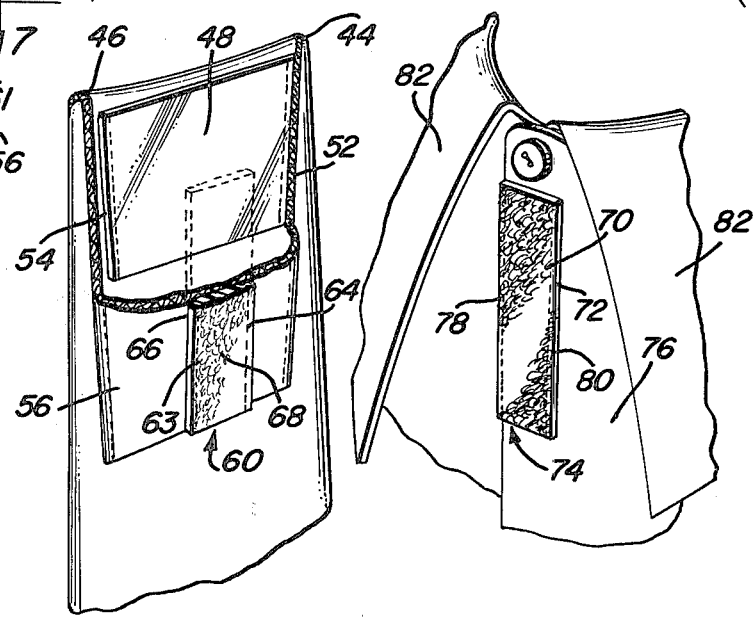
FIG. 6 is a group perspective view of a fragment of a shirt adapted for use with the second embodiment, along with a fragmentary, partially broken away back view of the tie constituting the second embodiment.
Figure 8:
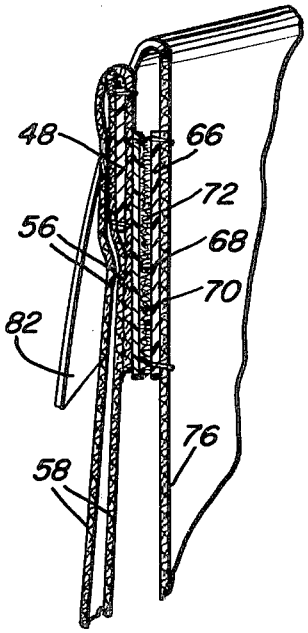
FIG. 8 is a longitudinal sectional view of the second embodiment, showing a fragment of the collar and shirt portion with the tie attached.
Figure 7:
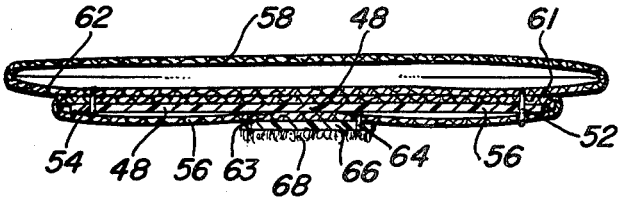
FIG.7 is a transverse sectional view of the second embodiment, showing only the tie portion and its associated holder.

In FIG. 5, sash tie 42 has upper corners 44 and 46, which are held to an upright position by support from holder 48, which is preferably made of a light piece of plastic curved to cause the upper edge 50 to conform with the curvature of the wearer's neck. Holder 48 is held in place by stitching along edges 52 and 54, which passes through folded portion 56 of sash tie 42. Folded portion 56 is fastened to front portion 58 of sash tie 42 by sewing or stitching along edges 61 and 62. Accordingly, in this embodiment, plastic holder 48 is not visible from either the front or back of sash tie 42. Fastening member 60 is stitched or sewn to upper portion 56 at seams 63 and 64. Fastening member 60 is made up of a backing support 66 to which are attached the hook and loop type Velcro fasteners 68. A strip of the cooperating type fastener material 70, attached by conventional means to support backing 72, comprises fastening member 74, which is attached to shirt 76 by stitching or sewing along seams 78 and 80. When fastening member 60 is applied with manual pressure to fastening member 74 with edges 44 and 46 under collar 82, the hook and loop type outwardly facing fastener surfaces engage to provide a secure mounting for sash type 42 on shirt 76.

Figure 2:
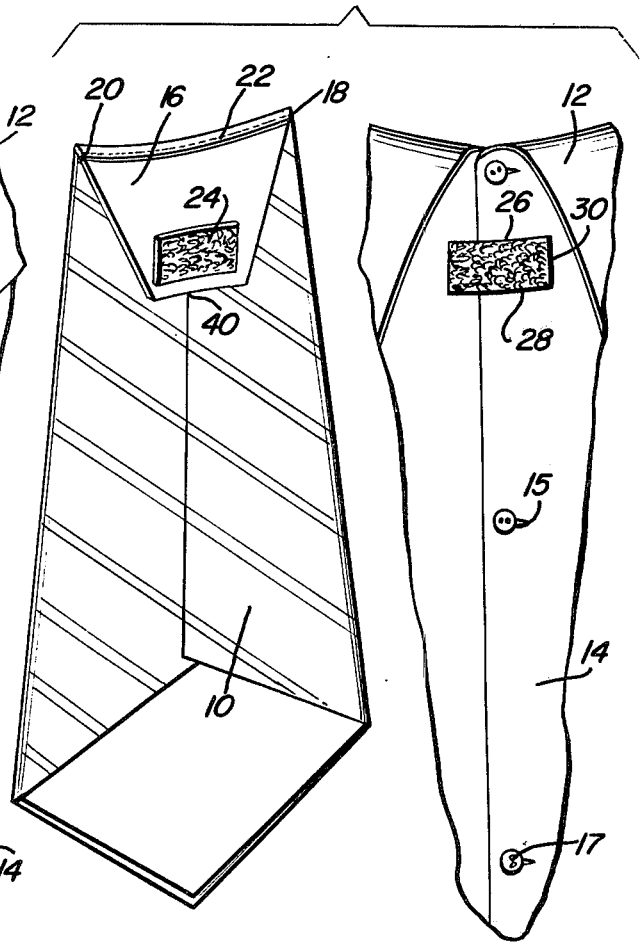
FIG. 2 is a group perspective view of components of the invention showing a partial fragmentary front view of the shirt and a back view of the tie.

A second fastening member can be applied optionally to shirt 14 beneath fastener 26, such as between buttons 15 and 17 on shirt 14 (see FIG. 2). A corresponding second fastener on a lower portion of sash tie 10 would then be engageable therewith to provide an additional point of attachment and avoid the necessity of wearing a tie clip or tie tack.

Decorative embellishments or ornamentation can be applied to the tie including buttonholes near corners 44 and 46 for attaching a chain ornament. In addition, a decorative button can be attached, such as a campaign button. When buttonholes are present on the sash tie, the Velcro fastener can be stapled, stitched or sewed on the buttonhole trim between the upper two buttonholes on the tie. Moreover, the Velcro patch on the shirt can be stapled, stitched or sewn on the buttonhole trim between two buttonholes on the shirt.

It is preferred that the sash tie of the present invention be somewhat wider and shorter than a conventional necktie, giving a more attractive and streamlined article of clothing, as well as an item of neckwear more easily attached under the collar of the shirt. Inasmuch as less material is required than for manufacture of a conventional necktie, the cost of production of the sash tie of the present invention can be less than that of conventional neckwear and less material used for its construction.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new follows:

1. An item of clothing for a wearer comprising in combination a sash tie, a holder for the sash tie with tie fastening means on the sash tie or holder, and a shirt having a collar and shirt fastening means attached to the front portion of the shirt and removably engageable with said tie fastening means when the shirt is buttoned to the collar, the sash tie comprising a folded portion and a front portion wherein the holder is stitched to the folded portion so as not to be visible from either the front or back of the sash tie, said sash tie having upper corners held in place by support from said fastening means so that the sash tie is held in place solely by engagement of said tie fastening means with said shirt fastening means by manual pressure on said holder, whereby only the front portion of the tie is visible on the wearer when the shirt is buttoned to the collar and the tie fastening means engages the shirt fastening means.

2. The item of claim 1 wherein said tie fastening means comprises a hook and loop type reusable cooperating patch, and said shirt fastening means comprises a compatible hook and loop type reusable cooperating patch engageable with said tie fastening means.

3. The item of claim 2 wherein said holder comprises a sheet of light plastic attached by stitching to the upper portion of said sash tie, the sheet of plastic being curved to conform with the curvature of the wearer's neck.

4. The item of claim 3 wherein said tie fastening means is stitched to said plastic holder through the folded portion.

5. The item of claim 4 wherein said sash tie comprises a strip of cloth stitched to said plastic holder along the upper corners of said cloth, said tie fastening means being disposed on the outward facing surface of said plastic holder.

6. The item of claim 5 wherein said tie fastening means comprises a rectangular patch near the top of said sash tie, and said shirt fastening means comprises a rectangular patch substantially corresponding to said tie fastening means and attached to the upper portion of the front of said shirt.

7. The item of claim 6 together with a second tie fastening means attached to the lower portion of said sash tie and a second shirt fastening means corresponding substantially to said second tie fastening means and attached to the front portion of said shirt.

8. The item of claim 2 wherein said sash tie comprises a strip of cloth folded over said plastic holder to form said folded portion and a remainder portion, said folded portion being stitched to the remainder portion of the sash tie.

9. The item of claim 8 wherein said tie fastening means comprises an elongated vertical strip attached to said folded portion, and said shirt fastening means comprises a substantially corresponding elongated vertical strip attached to the upper front portion of said shirt.

10. The item of claim 9 together with a second tie fastening means attached to the lower portion of said sash tie, and a second shirt fastening means corresponding substantially to said second tie fastening means and attached to the front portion of said shirt.

* * * * *